US005949684A

United States Patent [19]

Kirkwood-Azmat

[11] Patent Number: 5,949,684

[45] **Date of Patent: *Sep. 7, 1999**

[54] AUTOMATIC ROLL GROOVE ALIGNMENT

[75] Inventor: Ruth E. Kirkwood-Azmat, Jefferson, Mass.

[73] Assignee: Morgan Construction Company, Worcester, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/813,599

[22] Filed: Mar. 7, 1997

[51] Int. Cl.[6] ..... G06F 19/00

[52] U.S. Cl. ..... 364/472.04; 72/6.2

[58] Field of Search ..... 364/472.04; 82/91; 72/6.2, 7.1, 7.2, 8.1

[56] References Cited

U.S. PATENT DOCUMENTS

| | | | |
|---|---|---|---|
| 3,429,167 | 2/1969 | Sieurin et al. | 72/247 |
| 4,154,074 | 5/1979 | Mercer et al. | 72/21 |
| 5,146,409 | 9/1992 | Atkinson | 364/472.04 |

FOREIGN PATENT DOCUMENTS 0388096 9/1990 European Pat. Off. .

OTHER PUBLICATIONS

Patent Abstracts of Japan, vol. 15, No. 294 Jul. 25, 1991.

"Quick Alignment for Bar Mill Stands", Steel Times—Incorporating Iron & Steel, vol. 225, No. 1, Jan. 1997, p. 17.

*Primary Examiner*—Paul P. Gordon

*Attorney, Agent, or Firm*—Samuels, Gauthier & Stevens

[57] ABSTRACT

Data representing the axial distance of the center of each groove of a work roll from a first reference location on the work roll is determined and stored in the memory of a data processing system. The work rolls are then mounted in the roll stand and the grooves of a selected "setup" roll pass are brought into alignment with each other. Thereafter, the roll stand is placed on the rolling line, the setup pass is aligned with the mill passline in the case of vertical stands, or with the mill center line in the case of horizontal roll stands, and data representing the relative positions of the work rolls to the roll stand and of the roll stand to another reference location is obtained and stored in the memory of the data processing system. This data is then employed by the system to calculate and automatically effect adjustments to the roll stand and work rolls in order to precisely align other roll passes with the mill passline or center line. Time consuming manual adjustments and repetitive trial runs are avoided, with concomitant reductions in mill down time.

7 Claims, 3 Drawing Sheets

AUTOMATIC ROLL GROOVE ALIGNMENT

BACKGROUND OF THE INVENTION

1. Field of the Invention

This invention relates to rolling mills in which bars, rods and other like long products are continuously hot rolled in the roll passes of multi-groove rolls, and is concerned in particular with an improvement in the alignment of the grooves of individual roll passes with each other, as well as the alignment of roll passes with the mill passline (for vertical stands) and with the mill center line for (horizontal stands).

2. Description of the Prior Art

In conventional bar and rod rolling mills, the grooves of the work rolls are for the most part manually aligned with each other and with the mill passline or center line. This is a time consuming task, often requiring repetitive trial runs before satisfactory alignment is achieved. Accuracy depends largely on the "eye and feel" of the mill operator. Setup inconsistencies from operator to operator are inevitable. All of this impacts negatively on production efficiency.

The object of the present invention is to provide a method and system for automatically achieving precise, rapid and repeatable groove settings and roll pass alignments.

SUMMARY OF THE INVENTION

In accordance with the present invention, data representing the axial distance of the center of each groove of a work roll from a first reference location on the work roll is determined and stored in the memory of a data processing system. The work rolls are then mounted in the roll stand and the grooves of a selected "setup" roll pass are brought into alignment with each other. Thereafter, the roll stand is placed on the rolling line, the setup pass is aligned with the mill passline in the case of vertical stands, or with the mill center line in the case of horizontal roll stands, and data representing the relative positions of the work rolls to the roll stand and of the roll stand to another reference location is obtained and stored in the memory of the data processing system. This data is then employed by the system to calculate and automatically effect adjustments to the roll stand and work rolls in order to precisely align other roll passes with the mill passline or center line. Time consuming manual adjustments and repetitive trial runs are avoided, with concomitant reductions in mill down time.

DETAILED DESCRIPTION OF THE ILLUSTRATED EMBODIMENTS

Figure 1:
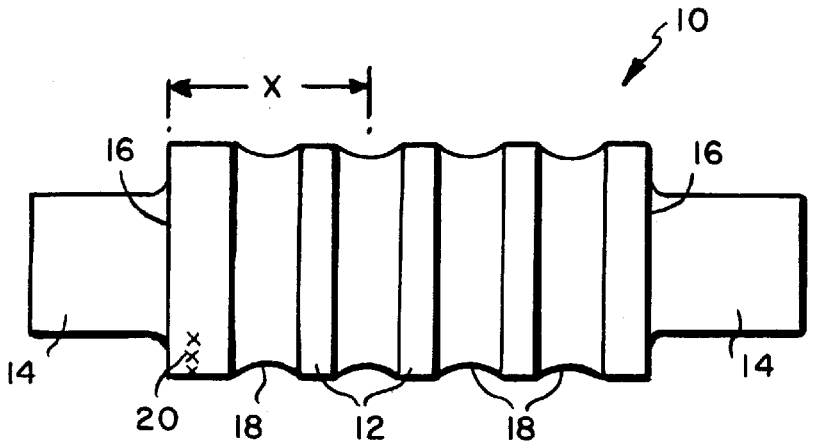
FIG. 1 is an illustration of the typical multi groove work roll.

With reference initially to FIG. 1, a typical work roll is shown at 10 comprising a roll barrel 12 with reduced diameter necks 14 extending axially in opposite directions from roll end faces 16. The roll barrel is grooved as indicated typically at 18 and carries identifying indicia 20.

An initial step in the method of the present invention entails determining the axial distance "X" of the center of each groove 18 from a reference location on the roll. The reference location can be a roll end face 16 as shown in FIG. 1, or another arbitrarily selected location evidenced by some permanent mark on the roll surface. For new rolls, this information can either be measured or obtained from the roll manufacturer. When roll profiles undergo changes as a result of redressing, the same information can be obtained from computer generated data or physical measurements performed by mill personnel. "First data", including for each work roll 10, the spacings X of the roll grooves and the roll identifying indicia 20, is loaded into the memory 24 of a data processing system schematically depicted in FIG. 4. The indicia 20 is typically entered manually via a keyboard 22 or other comparable input device. The groove spacings X can also be entered manually, or if represented by computer generated data, can be entered automatically when being compiled by operating personnel. Memory 24 is operatively coupled to a computer processor 26.

Continued description of the invention will be made with reference to a vertical roll stand. It is to be understood, however, that with appropriate revisions to descriptive terminology, the same concepts and methodology are fully applicable to horizontal roll stands.

Figure 2:
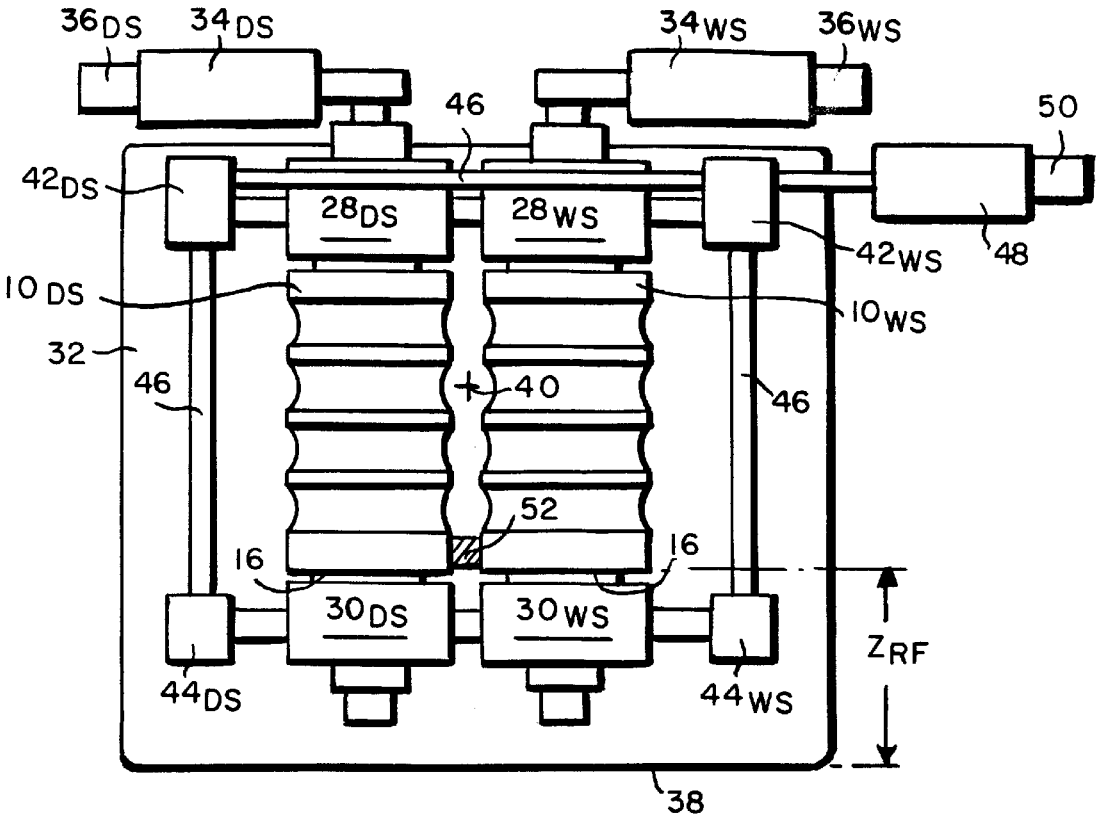
FIG. 2 is a somewhat schematic illustration of a vertical roll stand at an off line location during initial setup.

With reference additionally to FIG. 2, two work rolls $\mathbf{10}_{DS}$, lows are assembled with their respective bearing chocks $\mathbf{28}_{DS}$, $\mathbf{28}_{WS}$; $\mathbf{30}_{DS}$, $\mathbf{30}_{WS}$ and mounted in a conventional vertical roll stand 32. (As herein employed, the subscripts "DS" and "WS" designate "drive side" and "work side" components of the roll stand). The chocks 28, 30 may be of any known type which permit axial adjustment of the work rolls with respect to the roll stand. For example, and as described in U.S. Pat. No. 3,429,167, the disclosure of which is herein incorporated by reference, the upper chocks 28 may contain mechanisms to effect the axial roll adjustments, and the lower chocks 30 may be configured and mounted to accommodate such adjustments. The axial roll adjustment mechanisms are centered, i.e., moved to half their full ranges, before the work rolls and their respective chock sets are loaded into the stand housing.

Figure 4:
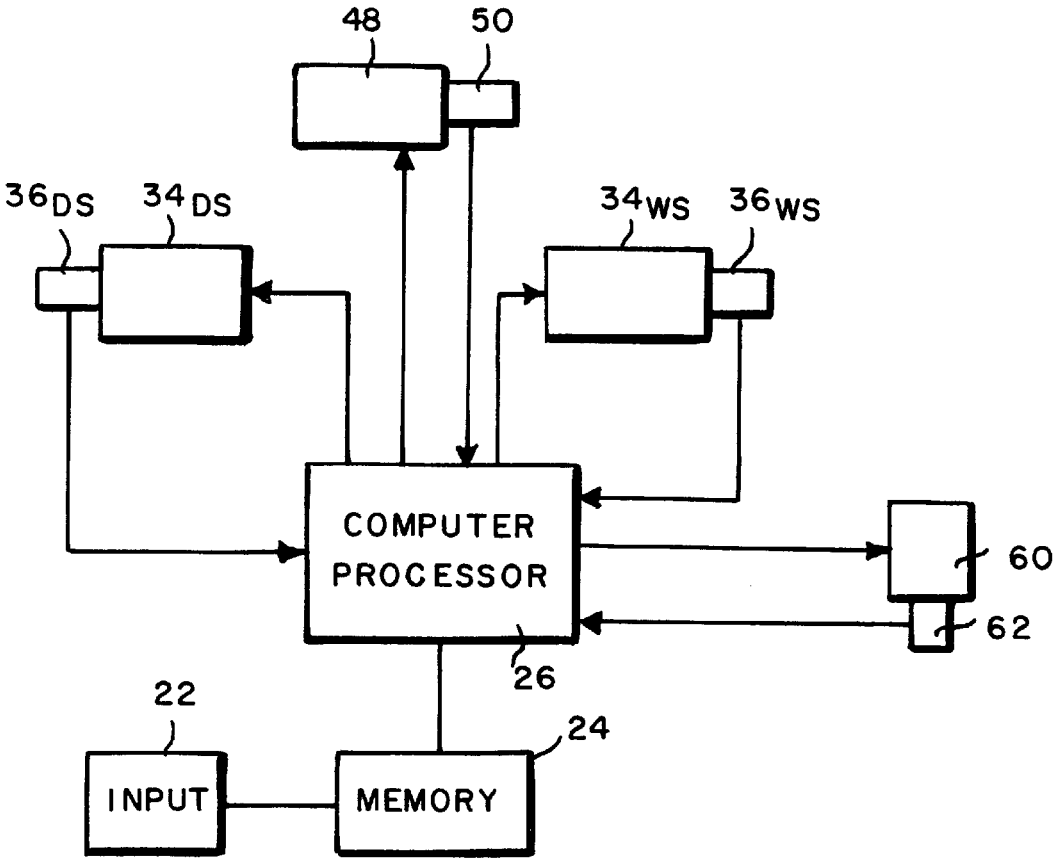
FIG. 4 is a diagrammatic illustration of a data processing system in accordance with the present invention.

In accordance with the present invention, the axial adjustment mechanisms of the upper chocks $\mathbf{28}_{DS}$, $\mathbf{28}_{WS}$ are driven by separately powered actuators $\mathbf{34}_{DS}$, $\mathbf{34}_{WS}$. Position measuring devices $\mathbf{36}_{DS}$, $\mathbf{36}_{WS}$ are coupled respectively to the actuators $\mathbf{34}_{DS}$, $\mathbf{34}_{WS}$. As shown in FIG. 4, the actuators $\mathbf{34}_{DS}$, $\mathbf{34}_{WS}$ are controlled by signals received from the computer processor 26, with the position measuring devices $\mathbf{36}_{DS}$, $\mathbf{36}_{WS}$ generating feed back signals representative of the axial adjustments being made to the work rolls.

During the initial setup phase as shown in FIG. 2, while the roll stand 32 is off line, the position measuring devices $\mathbf{36}_{DS}$, $\mathbf{36}_{WS}$ are reset to a known value. A prerecorded constant representing the axial distance $Z_{RFHB}$ between the first reference location 16 on each work roll and a second reference location 38 on the roll stand is stored as "second data" in memory 24. The second reference location 38 may be the underside of the roll stand housing, as illustrated, or at any other convenient location capable of providing a reliable reference datum.

One or both chock actuators $\mathbf{34}_{DS}$, $\mathbf{34}_{WS}$ are then manually operated to effect the axial roll adjustments necessary to bring the roll grooves of a setup pass 40 into precise alignment with each other. The accuracy of groove alignment can be checked optically using known methods and equipment.

Gap separation between the grooves of each roll pass is controlled by roll parting adjustment mechanisms $42_{DS}$, $44_{DS}$; $42_{WS}$, $44_{WS}$. These adjustment mechanisms are operably coupled, for example by shafts 46 and are driven by a common drive 48 to effect simultaneous symmetrical roll parting adjustments. A position measuring device 50 is associated with drive 48. Again, as shown in FIG. 4, the drive 48 is controlled by signals received from the computer processor 26, with the position measuring device 50 generating feedback signals representative of roll gap adjustments.

During the initial setup phase, the drive 48 is operated to close the rolls to a known gap, which may be defined by a shim 52, after which the position measuring device 50 is also reset to a known value and the shim then removed.

Figure 3:
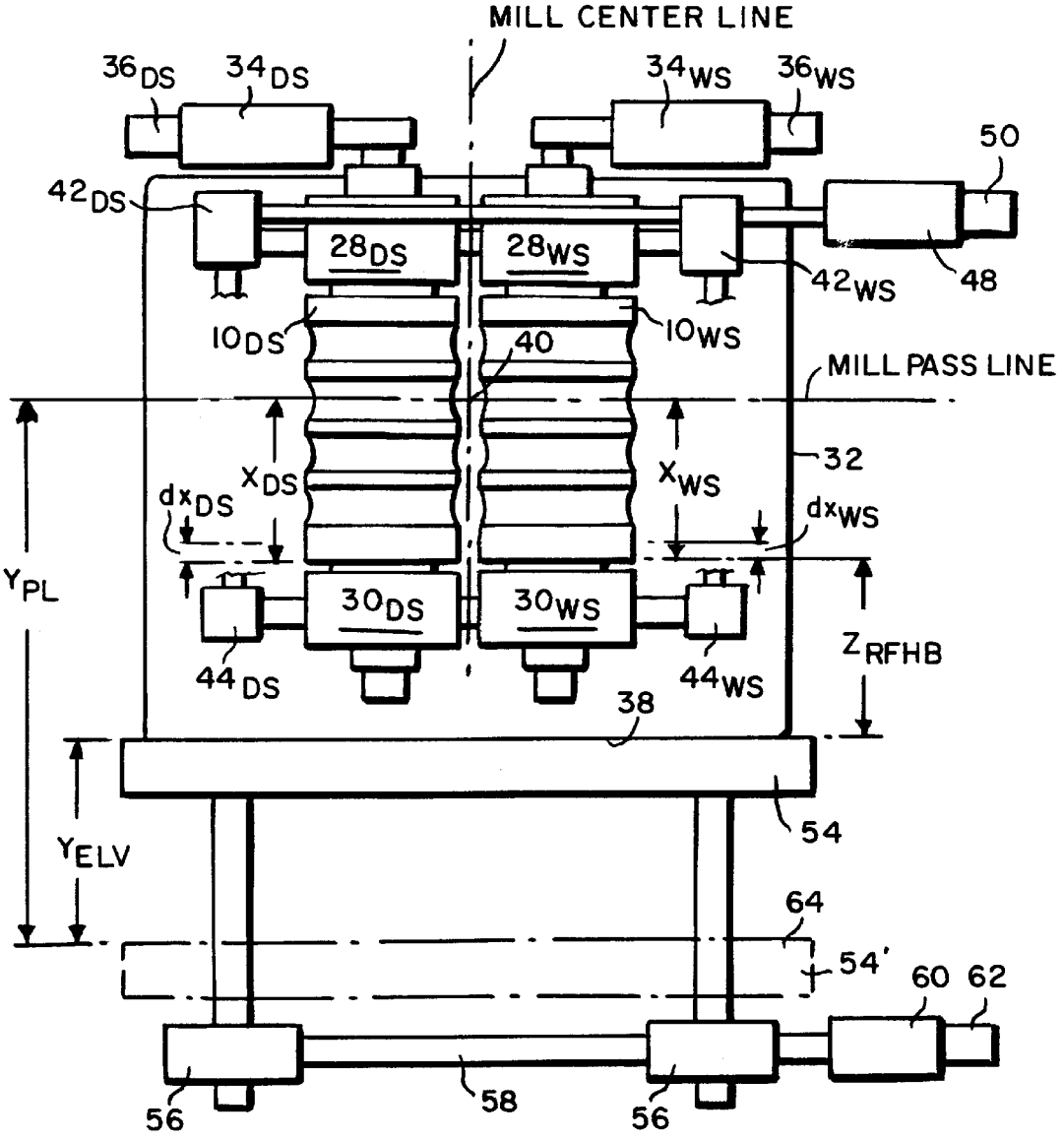
FIG. 3 is another somewhat schematic illustration of the same vertical roll stand located on the rolling line and operatively mounted on an elevator platform.

As shown in FIG. 3, the roll stand 32 is then moved to the rolling line and mounted on an elevator platform 54. The following dimensions are relevant to a continued description of the invention:

$Y_{PL}$=known constant distance measured from the mill passline to the support surface of elevator platform 54 at its lowermost position as indicated by the broken lines at 54'.

$X_{DS}$=distance from the center of the drive side groove of the roll pass being aligned to the roll end face 16 of the drive side roll $10_{DS}$.

$X_{WS}$=distance from the center of the work side groove of the roll pass being aligned to the roll end face 16 of the work side roll lows.

$Y_{ELV}$=height of the elevator 54 platform above the third reference location 64 defined by its lowermost position 54'.

$Z_{RFHB}$=distance between the roll end faces 16 and the roll stand base 38 (or the support surface of elevator platform 54) assuming no wear and a perfect assembly, and with no axial roll displacement, i.e., prior to alignment of the grooves of a setup roll pass.

$dx_{DS}$=axial displacement of the drive side roll.

$dx_{WS}$=axial displacement of the work side roll.

The elevator platform is vertically adjustable by powered mechanisms 56 of known design, operably coupled as by a shaft 58 or the like and driven by an actuator 60. Another position measuring device 62 is coupled to the actuator 60. At the lowermost position of the elevator platform 54, as depicted by the broken lines at 54', the support surface of the elevator platform defines a third reference location 64 spaced beneath the mill passline by the distance $Y_{PL}$. Again, as depicted schematically in FIG. 4, the elevator actuator 60 operates in response to control signals received from the computer processor 26, and the position measuring device 62 provides feedback signals to the computer processor representative of the elevation $Y_{ELV}$.

Using the identification indicia 20 for the work rolls $10_{DS}$ and $10_{WS}$ and an identification of the setup pass 40 entered by the mill operator, the computer processor 26 will retrieve from memory 24 the distances $X_{DS}$ and $X_{WS}$ of the setup pass grooves.

The computer processor then automatically signals the elevator drive 60 to elevate the platform through a distance $Y_{ELV}$ calculated by the computer processor 26 in accordance with the following equation:

$$Y_{ELV}=Y_{PL}-Z_{RFHB}-(X_{DS}+X_{WS})/2$$

This movement will place the setup pass 40 in approximate alignment with the mill passline. In the event that additional fine tuning adjustments are required to achieve more precise alignment, the elevator platform 54 and/or the work rolls $10_{DS}$, lows may be adjusted further through the computer processor. Any further roll adjustments will be performed simultaneously i.e., in tandem, so as not to alter the precise alignment of the grooves of the setup pass 40 with respect to each other. Here again the accuracy of the setup pass with the mill passline can be optically checked and verified by known procedures using conventional equipment.

After the setup pass 40 has been aligned with the mill passline, feedback from the work roll axial adjustment position measuring devices $36_{DS}$, $36_{WS}$ will be recorded in memory 24 as "third data" $dx_{DSSU}$, $dx_{WSSU}$, and feedback from the elevator platform position measuring device 62 will be recorded as "fourth data" $Y_{SU}$. The third data includes the sum of axial roll adjustments $dx_{DS}$, $dx_{WS}$ made to align the grooves of the setup pass 40 with each other, as well as any further tandem axial adjustments made to the work rolls to achieve more precise alignment of the setup pass with the mill passline. Likewise, the fourth data includes the sum of the elevator displacement $Y_{ELV}$ made to align the setup pass 40 approximately with the mill passline, and any further fine tuning adjustments made to the elevator to achieve more precise setup pass alignment.

Rolling can then commence through setup pass 40. If another roll pass is required for rolling, this can be brought into alignment with the mill passline through automatic adjustment, controlled by the computer processor 26, of the elevator platform actuator 60 and axial roll actuators $34_{DS}$, $34_{WS}$.

For a pass change, the computer processor 26 will retrieve from memory 24, using the identification indicia 20 for the work rolls $10_{DS}$ and lows and the number of the next pass "NP" entered by the operator, the distances $X_{NPDS}$ and $X_{NPWS}$ from roll end face 16, shown in FIG. 2, to the drive side and work side grooves of pass NP.

During a pass change, the computer processor 26 is programmed to employ the first, second, third and fourth data as follows:

A. Roll Stand Movement

With the setup pass aligned with the mill passline:

$$Y_{PL}=Y_{SU}+Z_{RFHB}+X_{DSSU}+dx_{DSSU}$$

For the next pass change:

$$Y_{PL}=Y_{NP}+Z_{RFHB}+X_{NPDS}+dx_{DS}$$

Therefore:

$$Y_{SU}+X_{DSSU}+dx_{DSSU}=Y_{NP}+X_{NPDS}+dx_{DS}$$

$$\text{and } Y_{SU}+X_{WSSU}+dx_{WSSU}=Y_{NP}+X_{NPWS}+dx_{WS}$$

To maximize the range available to align the rolls, the elevator position $Y_{NP}$ is calculated using a minimum difference between $dx_{DS}$ and $dx_{WS}$, i.e., by making them equal and opposite;

$$dx_{DS}=dx$$

$$dx_{WS}=-dx$$

Thus:

$$Y_{NP}=Y_{SU}+(X_{WSSU}+dx_{WSSU}+X_{DSSU}+dx_{DSSU}-X_{NPDS}-X_{NPWS})/2$$

On completion of this calculation, the computer processor 26, controls elevator actuator 60 to position the elevator platform at $Y_{NP}$, using feedback from position measuring device 62.

B. Axial Roll Adjustment

After elevator actuator 60 has moved elevator platform 54 as close as possible to elevator reference $Y_{NP}$, the actual elevator position $Y_{MEAS}$ is recorded based on feedback from position measuring device 62. To accurately position both groove halves of the next roll pass on the mill passline, $Y_{MEAS}$ is then employed in the following equations to calculate the axial position references required for both the DS and WS work rolls within their respective bearings:

Thus:

$$dx_{DS}=Y_{SU}-Y_{MEAS}+dx_{DSSU}+X_{DSSU}-X_{NPDS}$$

$$\text{and } dx_{WS}=Y_{SU}-Y_{MEAS}+dx_{WSSU}+X_{WSSU}-X_{NPWS}$$

On completion of these calculations the computer processor 26 operates the work roll actuators $\mathbf{34}_{DS}$ and $\mathbf{34}_{WS}$ to move the drive side and work side rolls $\mathbf{10}_{DS}$, $\mathbf{10}_{WS}$ within their respective bearing by distances $dx_{DS}$ and $dx_{WS}$ using feedback from position measuring devices $\mathbf{36}_{DS}$ and $\mathbf{36}_{WS}$.

Any further pass changes required with the same roll stand 32 are performed using the same method.

In light of the foregoing, it will now be understood by those skilled in the art that the same methodology can be applied to horizontal roll stands, where the roll passes are aligned with the mill center line by axial adjustment of the work rolls in combination with horizontal rather than vertical stand movement.

I claim:

1. In a rolling mill wherein bars, rods and other like long products are directed along a path for rolling between a pair of work rolls mounted in a roll stand, said work rolls being adjustable axially with respect to said roll stand and having cooperating pairs of grooves defining multiple roll passes, said roll stand being shiftable relative to said path in opposite directions parallel to the axes of said work rolls, a method of aligning the grooves of selected roll passes with each other and with said path, said method comprising the steps of:

(a) for each work roll, providing first data indicative of the values of the axial distance between the center of each roll groove and a first reference location on the work roll;

(b) determining second data representative of the axial distance between the first reference location on each work roll and a second reference location on the roll stand;

(c) axially adjusting at least one of the work rolls with respect to said second reference location to bring the centers of the grooves of a selected one of the roll passes into alignment with each other;

(d) shifting the roll stand with respect to a fixed third reference location and when necessary, also axially adjusting the work rolls in tandem with respect to the roll stand, to position the selected one of the roll passes in alignment with said path;

(e) determining third data representative of the axial adjustments made to the work rolls in accordance with steps (c) and (d);

(f) determining fourth data representative of the distance between the second and third reference locations following the roll stand shifting of step (d);

(g) based on said first, second, third and fourth data, determining fifth data representative of the shifting required to be made to the roll stand accompanied when necessary by axial adjustment of at least one of the work rolls to align the grooves of another of the roll passes with said path; and (h) shifting the roll stand and if necessary axially adjusting at least one of the work rolls in accordance with said fifth data.

2. The method as claimed in claim 1 wherein said first reference location is the roll end face.

3. The method of claim 1 wherein said second data represents a constant for said roll stand.

4. The method of claim 1 wherein steps (a)–(c) are performed at a location removed from said path, and wherein steps (d)–(h) are performed while said roll stand is operatively positioned with respect to said path.

5. The method of claim 1 wherein following step (c), the gap between the work rolls is set to a known value.

6. In a rolling mill wherein bars, rods and other like long products are directed along a path for rolling between a pair of work rolls mounted in a roll stand, said work rolls being adjustable axially with respect to said roll stand and having cooperating pairs of grooves defining multiple roll passes, said roll stand being shiftable relative to said path in opposite directions parallel to the axes of said work rolls, a method of aligning the grooves of selected roll passes with each other and with said path, said method comprising the steps of:

(a) for each work roll, providing in an electronic memory device first data indicative of the values of the axial distance between the center of each roll groove and a first reference location on the work roll;

(b) determining second data representative of the axial distance between the first reference location on each work roll and a second reference location on the roll stand and storing first data in a memory device;

(c) axially adjusting at least one of the work rolls using said first data and said second data to bring the centers of the grooves of a selected one of the roll passes into alignment with each other;

(d) shifting the roll stand with respect to a fixed third reference location to position the selected one of the roll passes in alignment with said path; and (e) reshifting the roll stand using said first data to bring the grooves of another roll pass into alignment with said path.

7. The method of claim 6, wherein said step of shifting the roll stand includes the step of adjusting the work rolls in tandem with respect to the roll stand to position the selected one of the roll passes in alignment with said path.

* * * * *